US006095483A

United States Patent [19]

Mackay Sim et al.

[11] Patent Number: 6,095,483

[45] Date of Patent: Aug. 1, 2000

[54] EDGE LIFTING RECESS FORMER AND REINFORCEMENT SYSTEM

[75] Inventors: Rodney Mackay Sim, Epping; Barry James Metham, Illawong, both of Australia

[73] Assignee: Alan H. Reid Pty Ltd, Arndell Park, Australia

[21] Appl. No.: 09/003,584

[22] Filed: Jan. 6, 1998

Related U.S. Application Data

[62] Division of application No. 08/530,331, Dec. 12, 1995, Pat. No. 5,829,207.

[30] Foreign Application Priority Data

Apr. 8, 1993 [AU] Australia ..... PL8259

[51] Int. Cl.[7] ..... B28B 7/16

[52] U.S. Cl. ..... 249/175; 249/91; 249/96

[58] Field of Search ..... 249/83, 91, 96, 249/142, 175

[56] References Cited

U.S. PATENT DOCUMENTS

| | | | |
|---|---|---|---|
| 20,951 | 7/1858 | McGinniss | 249/175 |
| 4,623,308 | 11/1986 | Hellon | 249/83 |
| 4,796,851 | 1/1989 | Brechbuehler | 249/91 |
| 5,535,979 | 7/1996 | Ellis-callow | 249/142 |

*Primary Examiner*—Kuang Y. Lin

*Attorney, Agent, or Firm*—Jacobson, Price, Holman & Stern, PLLC

[57] ABSTRACT

A recess former (130) is adapted for forming a recess (133) around the head of an anchor element (131) which is embedded in an edge of a concrete slab during casting thereof. The recess former (130) has an outer curved surface extending from a flat base surface. The outer surface has a hole at its apex to allow the anchor (131) to extend out of the recess former (130). A web (137) is located at the outer surface and has a channel (138) which is adapted for positioning of shear reinforcement means. The web (137) forming an air gap after the recess former (130) is removed from the recess.

3 Claims, 11 Drawing Sheets

EDGE LIFTING RECESS FORMER AND REINFORCEMENT SYSTEM

This is a division of application Ser. No. 08/530,331 filed Oct. 4, 1995, now U.S. Pat. No 5,829,207.

The present invention relates to reinforcing precast or cast-in-place concrete elements and is particularly concerned with arrangements to facilitate the use of lifting anchors which are partially embedded in the concrete and have a projecting portion to which a lifting device is able to be engaged.

BACKGROUND ART

A particularly important area of application is where the lifting anchor is placed in the edge of an end or side of a thin concrete panel and where the panel is to be lifted in a direction normal to the axis of the anchor with a shear load applied to the anchor. A common application of this type exists in the construction of tilt-up buildings. In this type of construction thin wall panels are cast horizontally at ground level and raised into the vertical position by tilting the horizontal panel about one (lower) edge by lifting with anchors set in the opposite (upper) edge until it is in the vertical position. Then it is lifted into its final position to form a wall element.

The invention is not, however, limited to tilt-up operations and can be used in any application where an anchor is set either in an edge, or close to an edge, and where a force is to be applied in a direction towards the edge. Here there is a risk of failure of the concrete in the region of the edge as a result of the shear forces generated by the application of the force to the anchor. In such applications there is only a small distance between the anchor axis and the surface of the concrete panel in the direction of the applied force. Therefore there is often an insufficient volume of concrete to resist the applied load without failure.

Lifting anchors now in widespread use comprise a bar which at one end has a hole through which is threaded a reinforcement member. Alternatively, the one end of the bar has an enlarged foot. The reinforcement member or foot provides an anchorage to the concrete inside the panel. The other end of the bar provides a connection to the lifting device. Such anchors are commonly forged from steel. The means of connection can either be an enlarged head or a hole. Such lifting anchors and the systems by which they are lifted are described in U.S. Pat. No. 3,499,676 (1970), U.S. Pat. No 3,883,170 (1975) and U.S. Pat. No. 4,173,367 (1979) amongst others.

It is desirable to ensure that the head of the anchor to which the lifting device is attached does not protect from the concrete surface and a recess in the concrete is formed around the anchor for that purpose. The recess is commonly formed using a recess former which typically comprises a solid hemisphere which has a hole in the pole of the hemisphere into which the anchor head is placed and retained with a rubber grommet. The base of the hemisphere is attached to the interior of the mould wall. Such attachment is typically achieved by a number of holes passing through the hemisphere and back through which are passed bolts or nails. These enable the recess former to be directly nailed or bolted onto the face of the mould. In some applications the recess former is bolted onto the form or, in the case of steel moulds, a steel former can be directly welded to the form.

Another type of recess former in common use comprises two quarter-spherical parts inter-connected by a hinge (as disclosed in U.S. Pat. No. 4,296,909) or otherwise fastened together. These types of recess formers are moulded from steel, rubber or plastics and have internal structures designed to tightly retain the head of the anchor when the recess is closed about the shaft of the anchor. This provides positive support for the assembly fixed to the mould wall. This type of recess is commonly bolted to the mould wall using a centrally locating bolt passing into the flat portion of the recess former.

Another type of recess former comprises a steel hemisphere which is bored with a central tapered hole thereby forming a tapered ring element into which are fitted two or more identical, externally tapered, collets with an internal form designed to accept the head of the lifting anchor. Provision is made to draw the collets together and fix these to the mould wall once the assembly has been put together.

Yet another type of recess former is moulded from two identical quarter spheres of thin plastics material each of which has projections and slots moulded into the internal cavity to tightly retain the head of the anchor once the two halves are closed together around the anchor shaft. This type of recess former is commonly provided with a means of clipping the two halves together using pegs and holes or other fastening means moulded into the plastics. This type of recess former once fastened around the anchor is substantially secure and does not normally require fixing to a mould surface. Projections and clips can be moulded into the external face to retain a frame (e.g. of wire or a steel plate) by which the assembly can be supported during the moulding of the concrete.

In some embodiments of this type of recess former, the two halves of the recess former are firmly held together with an encircling wire frame which is tightly fitted around the recess former at a position designed to provide reinforcement against the shear forces generated when the anchor is placed in the edge of a panel. Supporting legs of wire are commonly fitted to the frame. They project into the concrete and serve as support legs for positioning the anchor when placed in the top of a horizontally cast panel or additional reinforcement and anchorage when the anchor is placed in the edge of a panel. Such assemblies are commonly placed into the edges of concrete panels by nailing onto timber formwork through the plastics or by tying the steel wire frame into the panel reinforcement. One such recess with special closure clips has been disclosed in Australian Patent No. AU-B-12822/88.

Each of these various types of recess formers can be provided with an exterior shape which is substantially hemispherical. In some cases the recess former is substantially a truncated hemisphere which produces a recess in the concrete which is slot-like when the recess former is removed to expose the anchor after the concrete has cured and hardened.

Lifting anchors can be effectively embedded in the face of precast concrete elements such as panels or beams and the longitudinal forces applied during lifting have not presented significant problems. However, when a shear load is applied i.e. force is applied at an angle to the axis of the lifting anchor, particularly where the anchor is near the edge of a precast panel, cracking of the concrete adjacent to the anchor has occurred. While this may not represent a problem structurally, the cracking is unsightly and unacceptable architecturally. Consequently costly patching and repair operations have been required.

The most common method which has been used to reduce the failures resulting from these shear forces has been to attempt to distribute these forces into the concrete by conducting the forces to an area away from the critical zone using reinforcement bars (shear bars). Attempts to provide an effective means of using anchors for receiving shear forces have included the disclosure of U.S. Pat. No. 4,087,947. Here extra reinforcing bars curve over the lifting anchor. The shear bar described in that patent is not effective for preventing damage to the concrete as a result of shear forces being transmitted by the lifting device to the inside surface of the recess in the concrete.

In order to reduce the damage it is known to use additional shear bars wrapped tightly around the recess former at a position in close approximation to the area of contact of the lifting device. Some recess formers of the types previously described and which have provision for fitting a circumscribing steel shear bar or wire have been used with some success (in this connection see Australian Patent No. AU-B-12822/88).

The shear bar is designed to accept the shear load which would otherwise be applied directly to the concrete and to transfer this load away from the concrete above the anchor to a position below the anchor. Such shear bars extend to a position below the level of the recess and have lateral extension pieces which provide anchorage. When the lifting device is forced against the shear bar by the applied shear load, the vertical section of the bar transmits the load to the anchored extension pieces in tension.

Another type of shear reinforcement uses a steel plate which has a centrally formed hole designed to accept the external form of the recess former (commonly used with truncated hemispherical formers which have two flat sides). This plate is turned inwardly towards the interior of the concrete at each end to provide a means of anchorage to the concrete. The plate is fitted around a recess which has provision for that purpose moulded into its external surface to ensure that it is positioned spatially at the optimum position to accept the shear load imparted by the lifting device.

The use of shear bars and plates and other similar variants of this type have been extensively tested in practical applications and in the laboratory and have been found to provide only a partial solution to the problem.

A different approach is that disclosed in U.S. Pat. No. 4,173,856. This patent describes a specially shaped anchor which prevents the lifting device making contact with the concrete element and which has special longitudinal extensions on the sides of the anchor which transmit the total applied shear force to the anchor. The anchor incorporates apertures for engagement of reinforcement rods through which the shear force is transmitted to the panel below the axis of the anchor. This solution has been found to be effective in most cases as failure has mainly occurred in very thin panels.

A disadvantage of the existing methods of transferring the shear loads into the concrete by using steel reinforcement bars has been that the bars have been directly embedded into the concrete and no account has been taken of the different physical properties of concrete and steel. The elastic modulus of cured concrete is very much greater than that of the steel used to provide the shear reinforcement.

When the force is applied to the steel it cannot be transferred by the steel until the steel extends elastically. The steel is restrained by the surrounding concrete. Extension of the steel is only possible if the surrounding concrete has an elastic modulus less than the steel. If the concrete is uncured its modulus can be less than that of the steel and it can permit the movement of the steel and the forces will be transferred by the steel. In most cases however the concrete has already cured and no transfer of the forces can take place until the concrete cracks and allows the steel to extend until the elastic force of the steel is equal to the applied force. This is the principle on which the theory of steel reinforcement of concrete is based.

A further disadvantage of existing methods using shear bars is that failure of the concrete panel can occur by bursting from the edge where the anchorage extension of the shear bar extends in the same plane as the edge of the panel (normal to the anchor axis). The applied force imparts a rotational force to the anchorage. Cracks opened by this force can initiate a failure crack which propagates in the direction of lift. Such cracking can occur at applied loads which are less than the loads required to cause the panel to fail in the direction of lift.

There is therefore a need for a device which ensures that the shear forces can be transferred by the reinforcement without prior concrete cracking. In many handling operations there are load reversals especially when manipulating a concrete member by rotation through 180 degrees. The device is therefore preferably capable of reinforcement in both directions.

OBJECT OF THE INVENTION

It is an object of the present invention to provide an improved anchor device for edge lifting of a concrete slab.

DISCLOSURE OF THE INVENTION

According to one aspect of the present invention there is disclosed an anchor device for the edge lifting of a concrete slab, said anchor device comprising an anchor element able to be partially embedded in said concrete slab, one end of said anchor element having a lifting head shaped to be within a recess formed in the edge of said slab located a small distance inwardly of the lifting head, and a shear reinforcement means able to be partially embedded in said slab to extend away from said lifting head and partially positioned within said recess, wherein that portion of said shear reinforcement means closest to said lifting head is closely spaced to said lifting head and, in use, able to be free of said concrete of said slab in the direction of lifting of said slab.

Preferably, an air gap is provided between said shear reinforcement means and said concrete of said slab in the direction of lifting of said slab.

According to another aspect of the present invention there is disclosed an anchor device for the edge lifting of a concrete slab, said anchor device comprising an anchor element able to be partially embedded in said concrete slab, one end of said anchor element having a lifting head shaped to be positioned within a recess formed in the edge of said slab located a small distance inwardly of the lifting head, and a shear reinforcement means extending away from said lifting head and able to be partially embedded in said slab and partially positioned within said recess, wherein said reinforcement means is isolated from contact with said concrete slab in the direction of lifting of said slab thereby allowing the shear reinforcement means to deflect without compressing the concrete and to substantially transfer the load through the shear reinforcement means to the concrete slab away from a critical zone of failure so that concrete failure does not occur.

According to a further aspect of the present invention there is disclosed a recess former for forming a recess around the head of an anchor element which is embedded in an edge of a concrete slab during casting thereof, said recess former having a curved surface for abutment with said concrete slab and a flat surface substantially co-planar with said edge of said concrete slab, wherein said recess former has a web with a channel for the positioning of a shear reinforcement means, said web providing an air gap between said concrete slab and said shear reinforcement after said recess former is removed from said recess.

Preferably, said web and said channel are integral with said recess former, while in another preferential embodiment, said web and said channel are adapted to be attached to an existing recess former.

BRIEF DESCRIPTION OF THE DRAWINGS

Some embodiments of the present invention will now be described with reference to the drawings in which.

BEST MODE OF CARRYING OUT THE INVENTION

Figure 1:
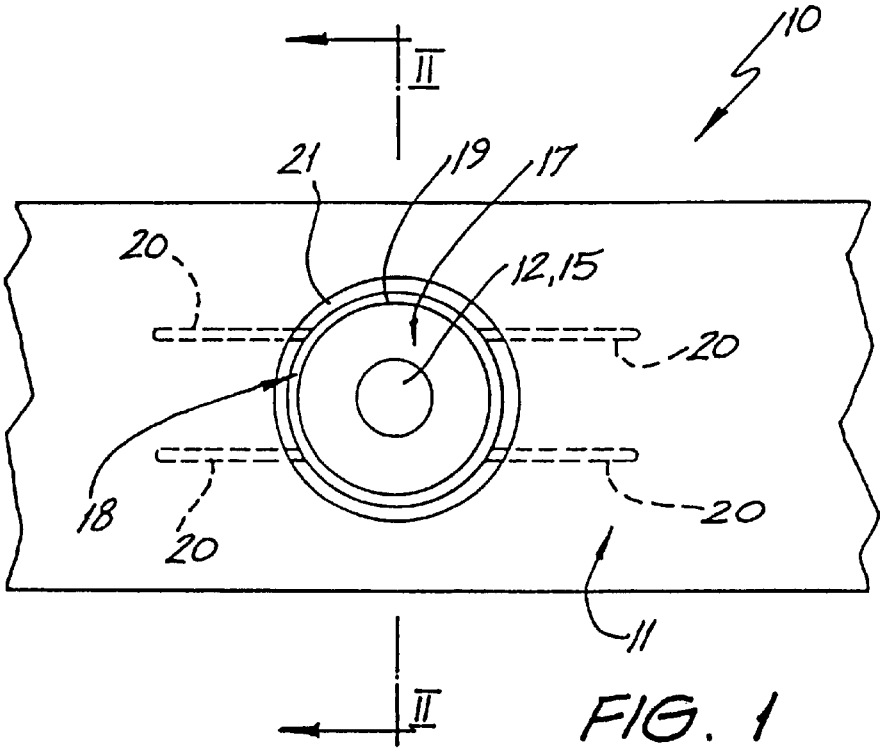
FIG. 1 is a partial front view of the top edge of a concrete slab with an anchor device of a first embodiment illustrated with its shear reinforcement embedded in the slab.
Figure 2:
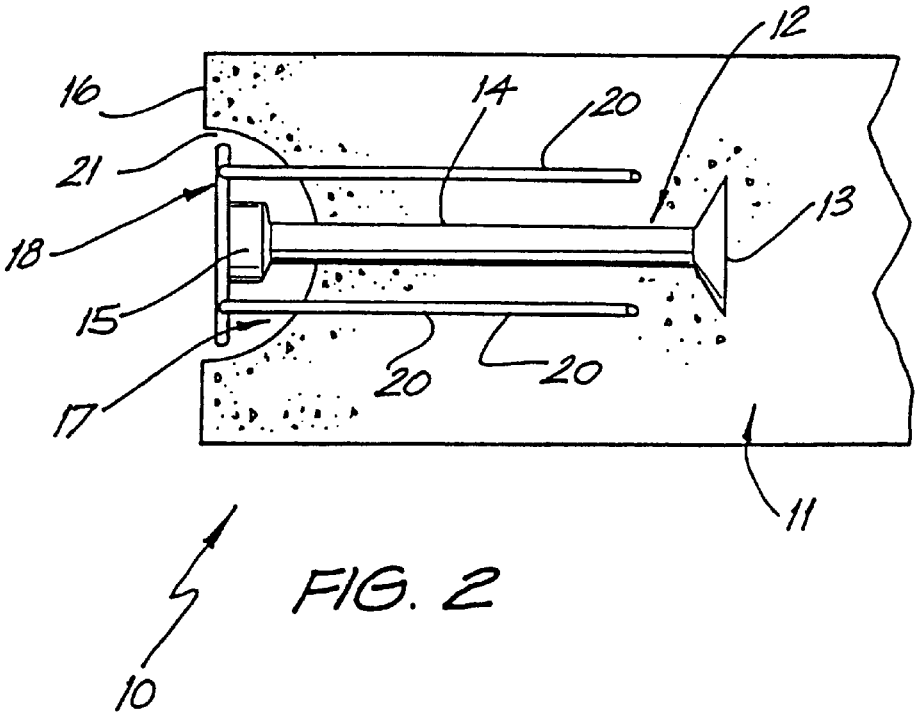
FIG. 2 is a transverse cross-sectional view in the direction of arrows II—II of FIG. 1.

An anchor device 10 of a first embodiment for the edge lifting of a concrete slab 11 is illustrated in FIGS. 1 and 2. The device 10 includes an anchor element 12 which is embedded in the concrete slab 11. The anchor element 12 has a foot portion 13, a shank 14 and a head 15. The head 15 is shaped to co-operate with conventional slab lifting apparatus (not illustrated). The head 15 is positioned a small distance inwardly of the edge 16 of the concrete slab 11 and is positioned within a recess 17 which is formed at the edge 16 of the slab 11 when the concrete is being poured. The recess 17 is formed using known techniques and the shank 14 and foot portion 13 are embedded in the slab 11 during the concrete pour.

Shear reinforcement 18, which is a separate item from the anchor element 12, is also partially embedded in the concrete slab 11 during the pour. The shear reinforcement 18 includes a ring portion 19 from which four reinforcing bars 20 extend into the concrete slab 11. The shear reinforcement 18 is positioned prior to the concrete pour and is embedded into the slab 11 during the pour with the bars 20 substantially embedded with the ring portion 19 being positioned within the recess 17. An air gap 21 is formed between the ring portion 19 and the concrete forming the recess 17.

When the concrete slab 11 is to be lifted, the lifting apparatus is engaged with the anchor element 12 in the edge 16 of the slab 11. As the lifting apparatus comes into contact with the ring portion 19, the shear forces are transmitted via the bars 20 of the shear reinforcement 18 which are below the axis of the anchor element 12. The air gap 21 between the ring portion 19 and the concrete slab 11 ensures that the shear force which is transmitted to the ring portion 19 above the axis of the anchor element 12 is not transmitted to the concrete at any position above the axis of the anchor element 12 in the direction of the lift. This prevents the concrete from failing at the junction of the reinforcement 18 and the recess 17. The shape of the ring portion 19 allows the anchor device 10 of the first embodiment to be used in either of the two directions of lifting as the ring portion 19 and air gap 21 totally surrounds the anchor element 12 within the recess 17.

Figure 1A:
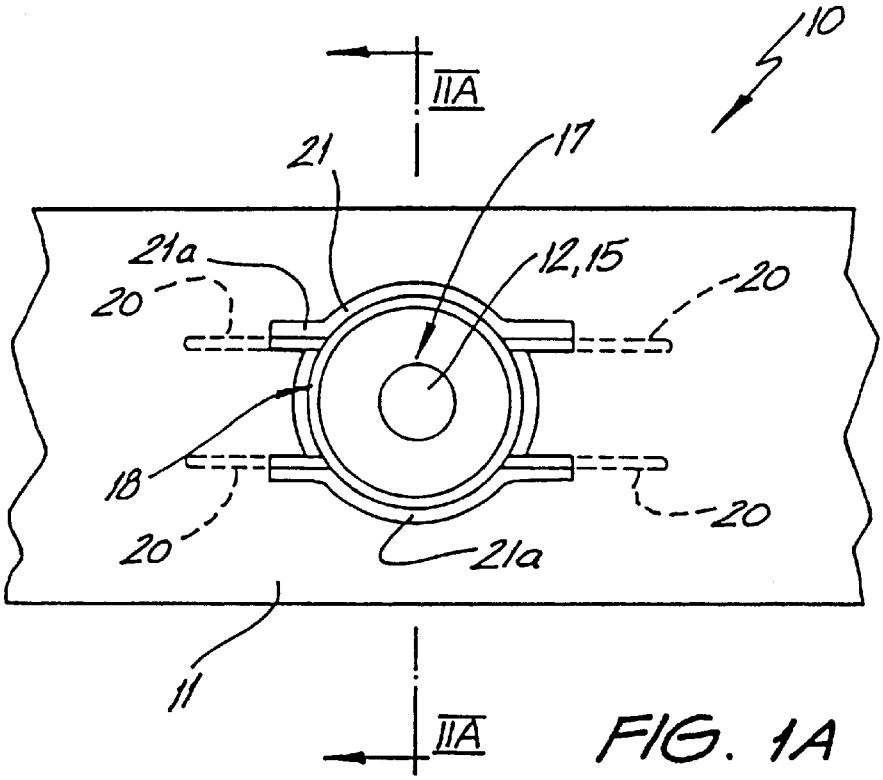
FIG. 1A is a partial front view of the top edge of a concrete slab with an anchor device which is a modification of the device of FIG. 1.
Figure 2A:
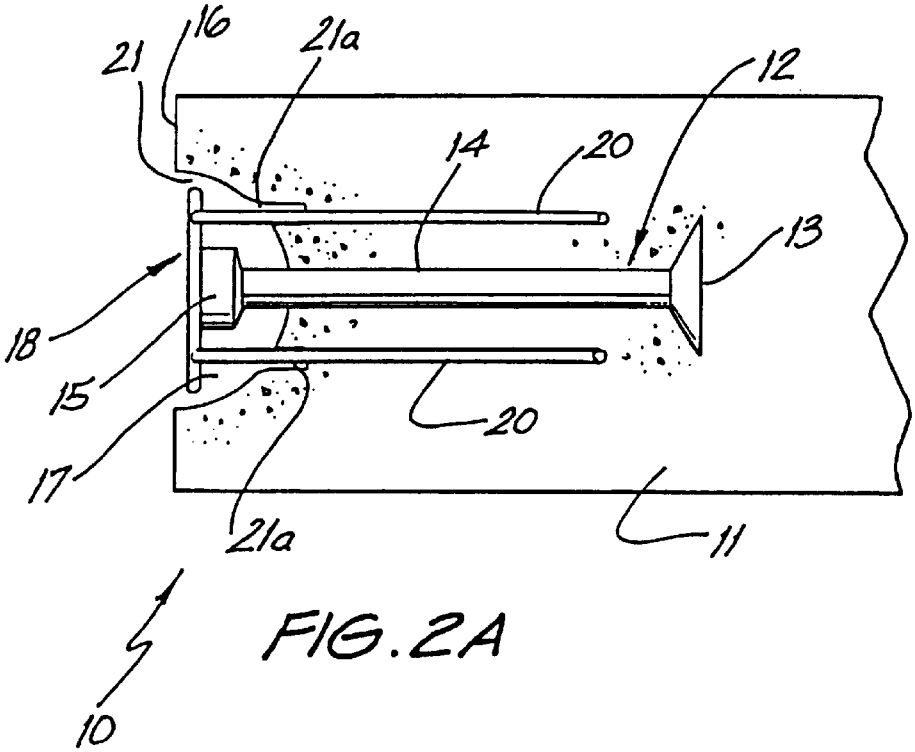
FIG. 2A is a transverse cross-sectional view along the lines IIA—IIA of FIG. 1A.

In a first modification to the anchor device 10, as illustrated in FIGS. 1A and 2A, an air gap 21*a* is cast into the concrete slab 11 when the recess 17 is formed and the shear reinforcement 18 is cast into the slab 11. The air gap 21*a* is provided over the reinforcement 18 in the region where the reinforcement 18 is expected to deflect during lifting before the load is shed to the reinforcing bars 20 which extend into the slab 11 below the anchor element 12. The air gap 21*a* is provided on both the top and bottom bars 20 so that the slab 11 can be lifted in either direction. The outside edges of the bars 20 are not in contact with the concrete in the slab 11 in the region of deflection whilst the inside edges are in close contact with the concrete as they provide an anchorage face for transferring the load into the concrete.

Figure 1B:
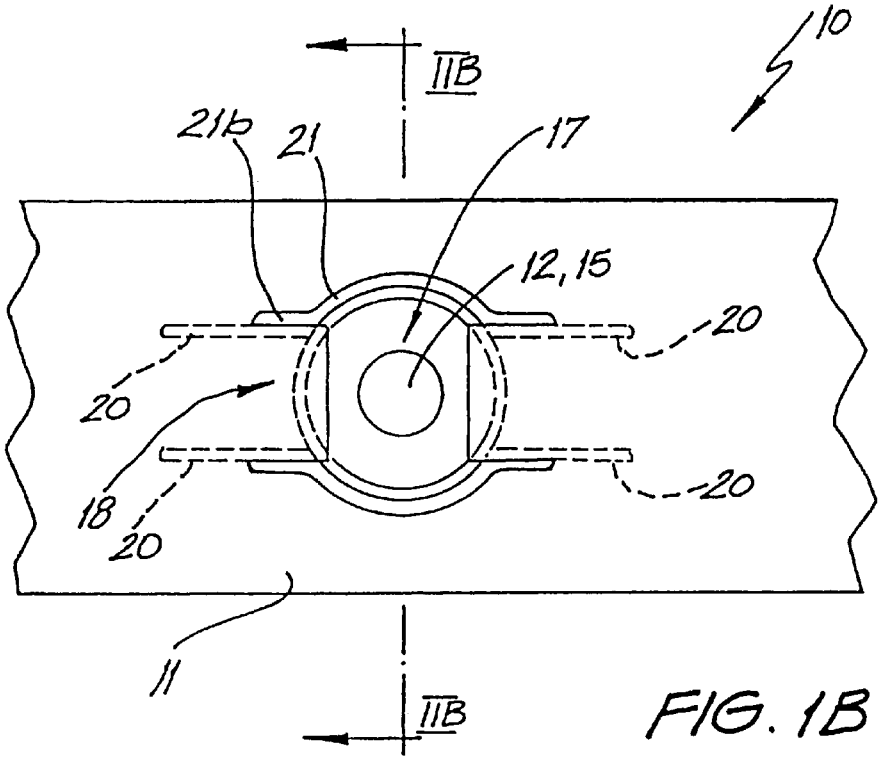
FIG. 1B is a partial front view of the top edge of a concrete slab with an anchor device which is a second modification of the device of FIG. 1.
Figure 2B:
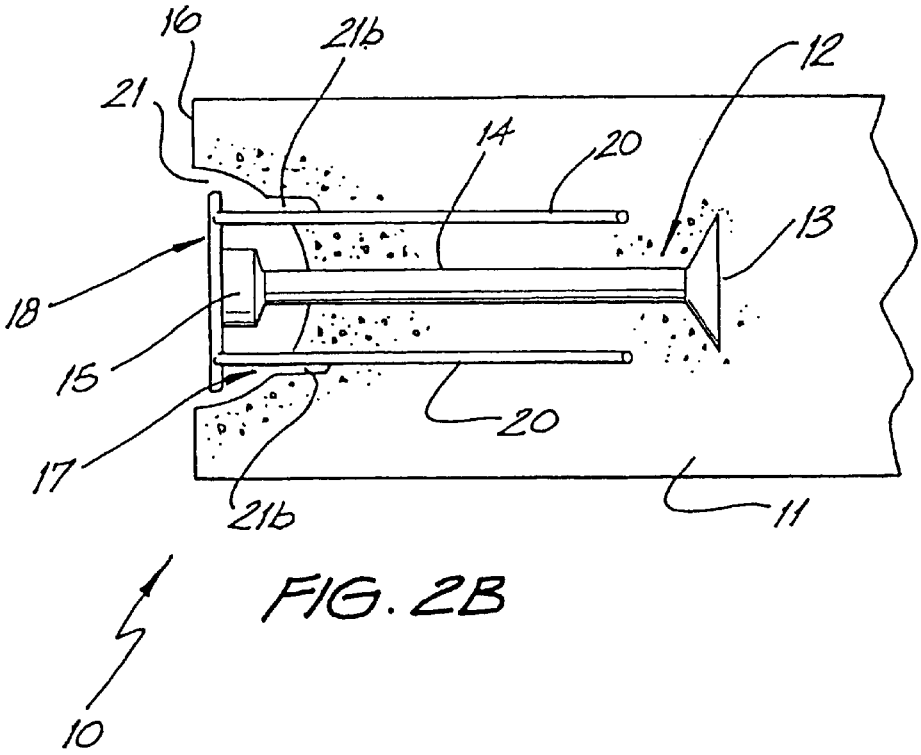
FIG. 2B is a transverse cross-sectional view along the lines IIB—IIB of FIG. 1B.

In a second modification to the anchor device 10, as illustrated in FIGS. 1B and 2B, an air gap 21*b* similar to air gap 21*a* is provided. In this modification, the recess 17*a* formed in the slab 11 is a truncated hemisphere with part of the ring portion 19 being embedded in the concrete slab 11.

Figure 3:
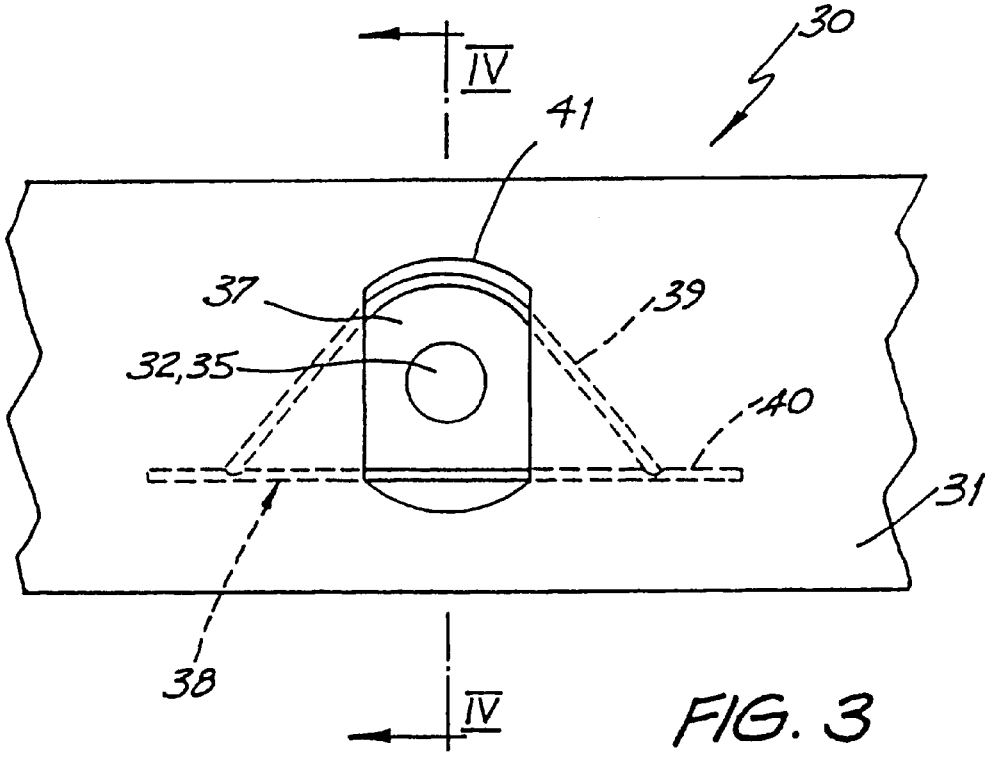
FIG. 3 is a front view of the top edge of a concrete slab with an anchor device of a second embodiment illustrated with its shear reinforcement embedded in the slab.
Figure 4:
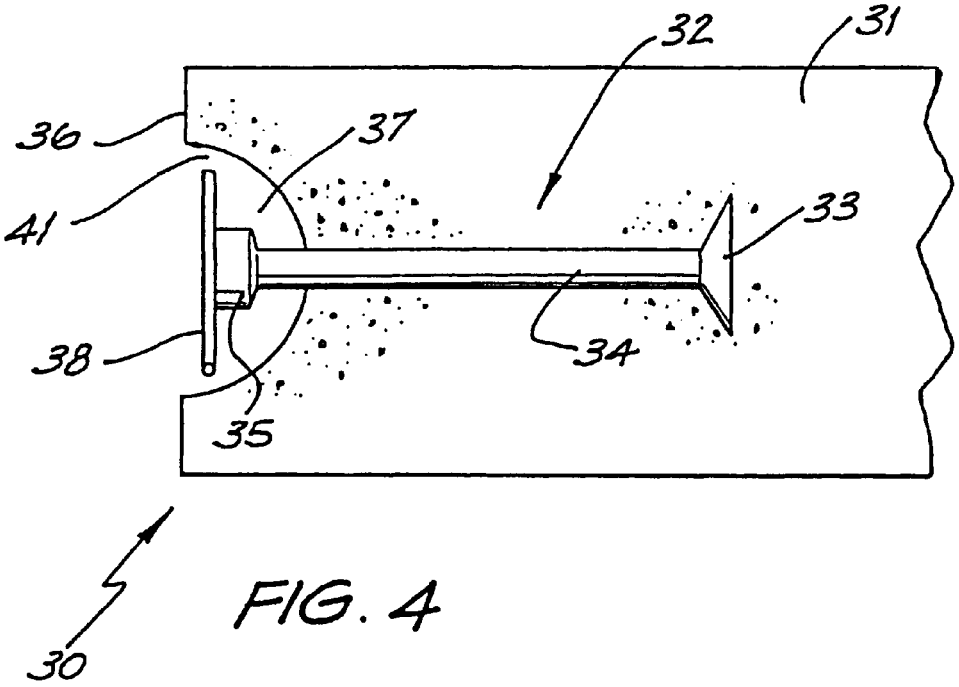
FIG. 4 is a transverse cross-sectional view in the direction of arrows IV—IV of FIG. 3.

An anchor device 30 of a second embodiment is illustrated in FIGS. 3 and 4. The device 30 which is used to edge lift a concrete slab 31, includes an anchor element 32 which is embedded into the concrete slab 31. The anchor element 32 is identical to the anchor element 12 and has a foot portion 33, a shank 34 and a head 35. The head 15 is positioned inwardly from the edge 36 of the concrete slab 31 and is positioned within a recess 37. The recess 37 in this embodiment is not hemi-spherical but is truncated at both sides.

Shear reinforcement 38 includes a single bar 40 which protrudes into the concrete slab 31 perpendicularly to the anchor element 32. The bar 40 spreads the shear load during lifting into the concrete slab 31 and passes through the recess 37 substantially at its lower portion as illustrated in FIG. 3. The shear reinforcement 38 also includes a brace portion 39 which is curved and extends upwardly above the bar 40. The brace portion 39 passes from the concrete slab 31 through the recess 37 with the centre of its curved portion being substantially at the top of the recess 37. The positioning of the brace portion 39 ensures that there is an air gap 41 located between the shear reinforcement 38 and the edge of the concrete at the recess 37.

This means that when the concrete slab 31 is to be lifted with the anchor element 32 being raised upwardly as seen in FIGS. 3 and 4 so that the head 35 moves the brace portion 39. The bar 40 of the shear reinforcement 38 which is below the axis of the anchor element 32 transmits the shear forces generated during lifting by the lifting apparatus coming into contact with the brace portion 39. The air gap 41 between the brace portion 39 and the concrete slab 31 ensures that the shear force is transmitted to the brace portion 39 above the axis of the anchor element 32 and is not transmitted to the concrete at any position above the axis of the anchor element 32 in this direction. Once again, the concrete is prevented from failing at the function of the reinforcement 38 and the recess 37.

Figure 5:
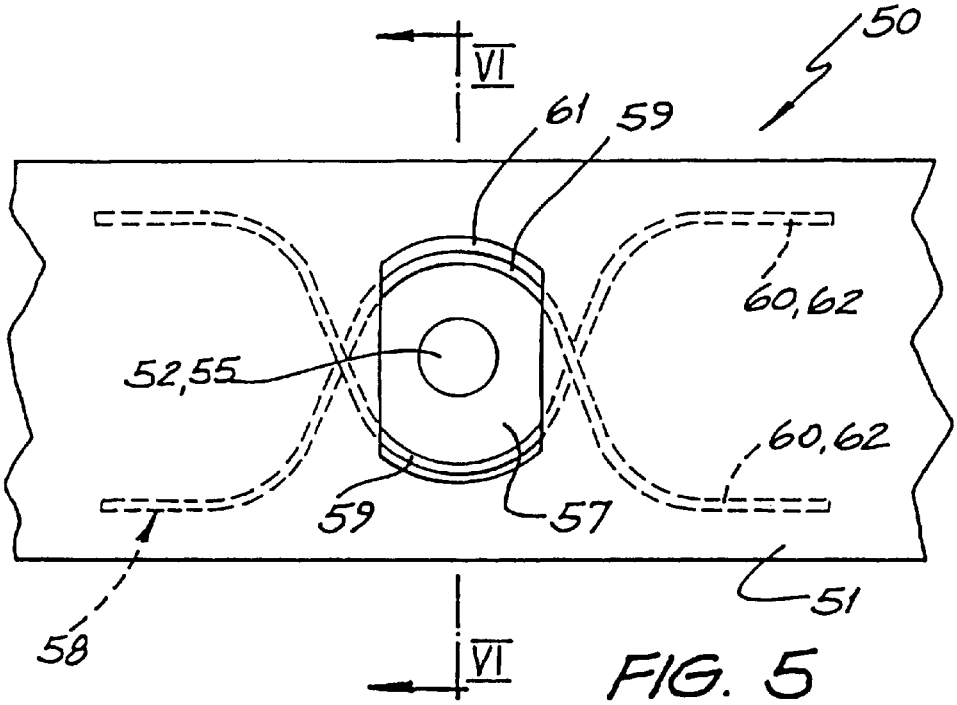
FIG. 5 is a front view of the top edge of a concrete slab with an anchor device of a third embodiment illustrated with its shear reinforcement embedded in the slab.
Figure 6:
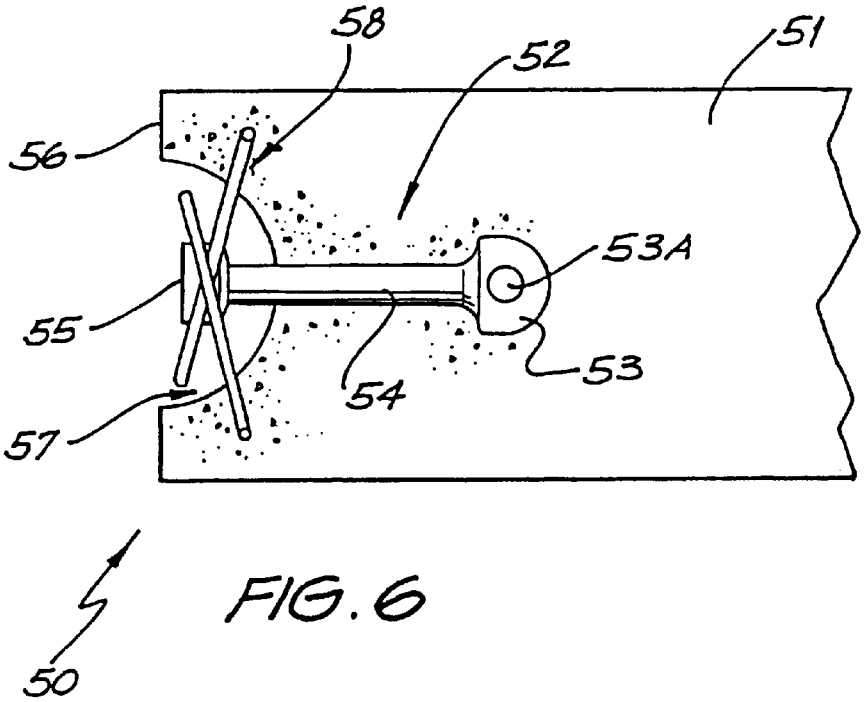
FIG. 6 is a transverse cross-sectional view in the direction of arrows VI—VI of FIG. 5.

An anchor device 50 of a third embodiment is illustrated in FIGS. 5 and 6. The anchor device 50 is used for the edge lifting of a concrete slab 51 and includes an anchor element 52 embedded therein. The anchor element 52 has a foot 53 with a hole 53A passing therethrough. The anchor element 52 also includes a shank 54 and a head 55. The head 55 is once again shaped to co-operate with existing slab lifting apparatus and is positioned a small distance inwardly from the edge 56 of the concrete slab 51 and is positioned within a recess 57 which is similar to recess 37. Shear reinforcement 58 which is embedded in the slab 51 includes two curved bars 60. The bars 60 include legs 62 which extend into the concrete slab 51 and act as an anchor and act to disperse the shear forces. The bars 60 each include a curved portion 59 which is located within the recess 57 in a similar manner to the previously described embodiments. The curved portion 59 ensures that there is an air gap 61 between the shear reinforcement 58 and the edge of the concrete within the recess 57. The positioning of the two separate curved bars 60 ensures that the concrete slab 51 can be lifted in either direction without causing cracking within the slab 51.

Figure 7:
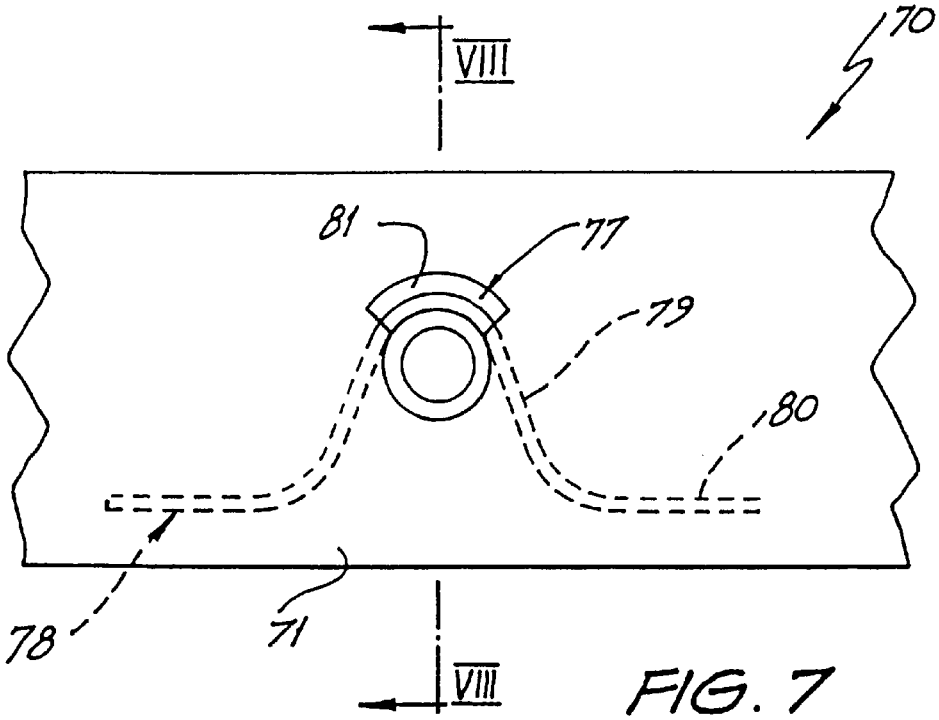
FIG. 7 is a front view of the top edge of a concrete slab with an anchor device of a fourth embodiment illustrated with its shear reinforcement embedded in the slab.
Figure 8:
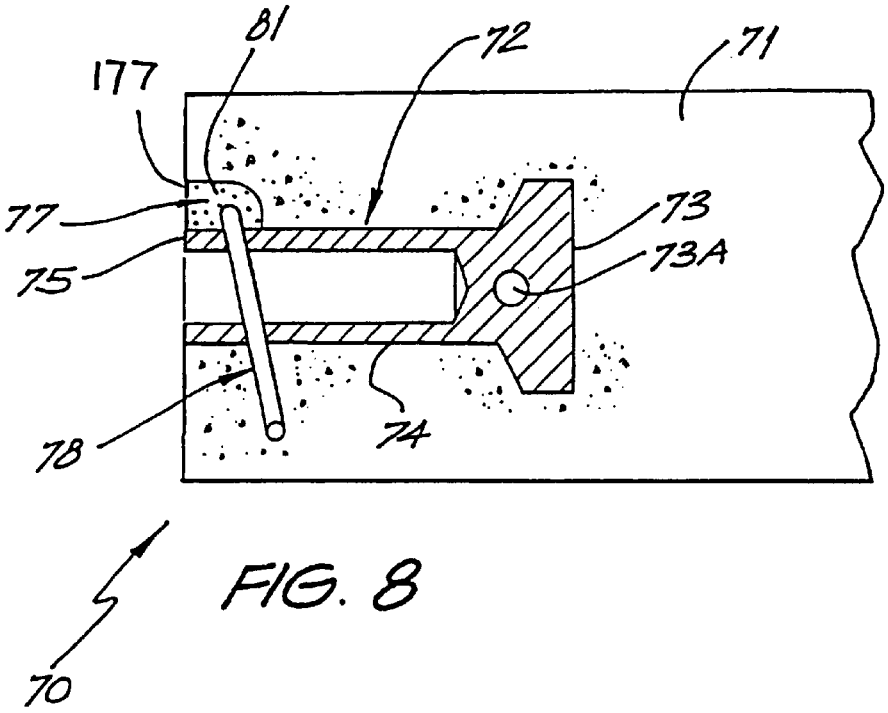
FIG. 8 is a transverse cross-sectional view in the direction of arrows VIII—VIII of FIG. 7.

An anchor device 70 of a fourth embodiment is illustrated in FIGS. 7 and 8. In this embodiment, the anchor device 70 includes an anchor element 72 embedded in a concrete slab 71. The anchor element 72 is a threaded insert and includes an internally threaded portion 74 and an enlarged foot 73 which has a hole 73A passing therethrough. The internally threaded portion 74 has its free end 75 flush with the edge 76 of the slab 71. A recess 77 is provided in the slab 71 in the edge 76 adjacent the top of the free end 75 of the internally threaded portion 74. The recess 77 is a partial annular ring and is clearly illustrated in FIG. 7.

A shear reinforcement 78 has a curved brace portion 79 and two legs 80 and is embedded in the slab 71. The shear reinforcement 78 abuts against the internally threaded portion 74 at its brace portion 79 and the legs 80 extend into the slab 71. The recess 77 acts as an air gap 81 in a manner similar to the other air gaps previously described and prevents the concrete slab 71 from cracking when lifted in that direction.

Figure 9:
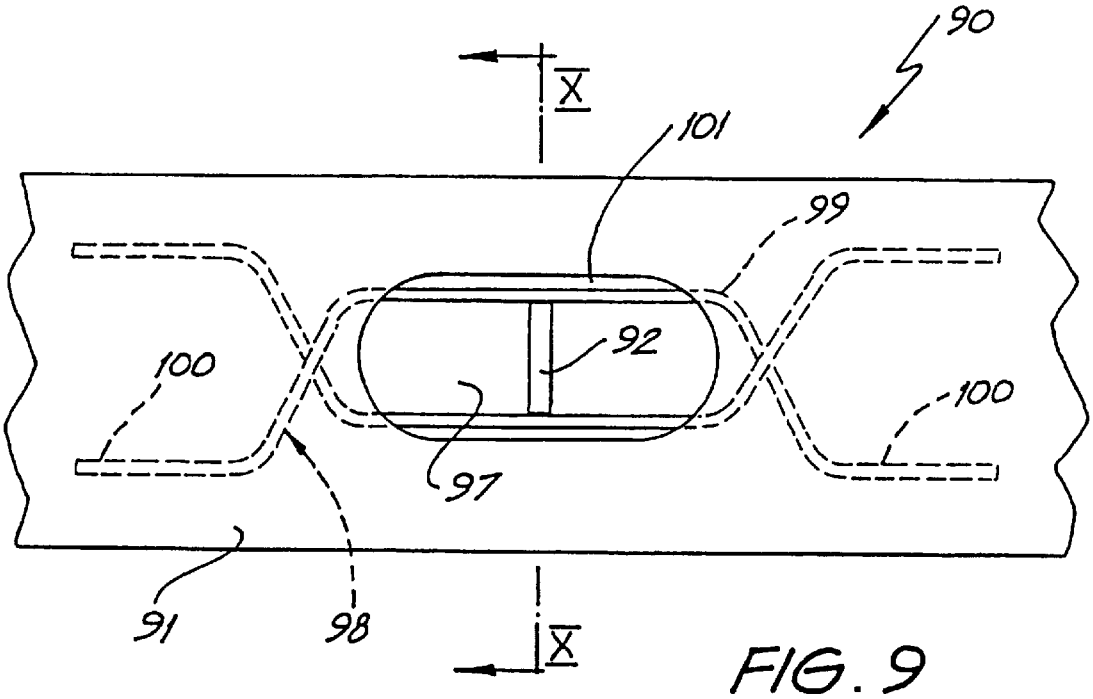
FIG. 9 is a front view of the top edge of a concrete slab with an anchor device of a fifth embodiment illustrated with its shear reinforcement embedded in the slab.
Figure 10:
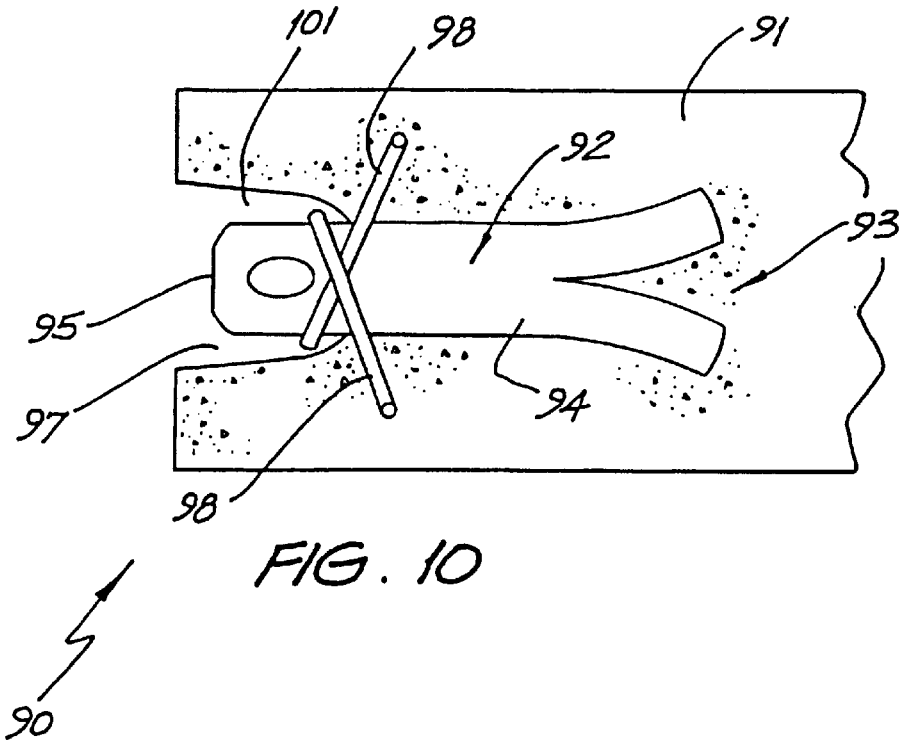
FIG. 10 is a transverse cross-sectional view in the direction of arrows X—X of FIG. 9.
Figure 9A:
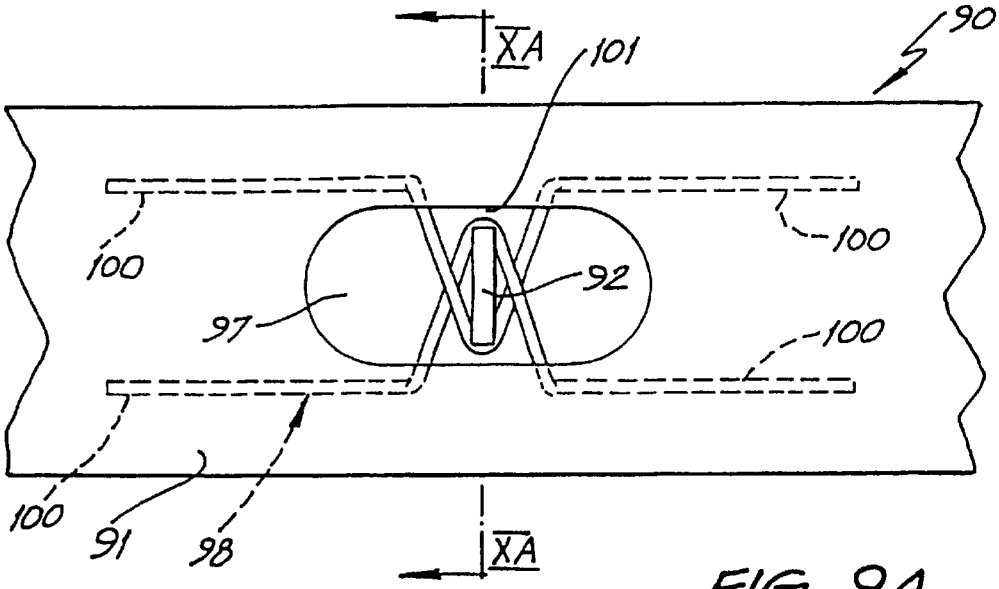
FIG. 9A is a front view of the top edge of a concrete slab with an anchor device of FIG. 9 illustrated with modified shear reinforcement embedded in the slab.
Figure 10A:
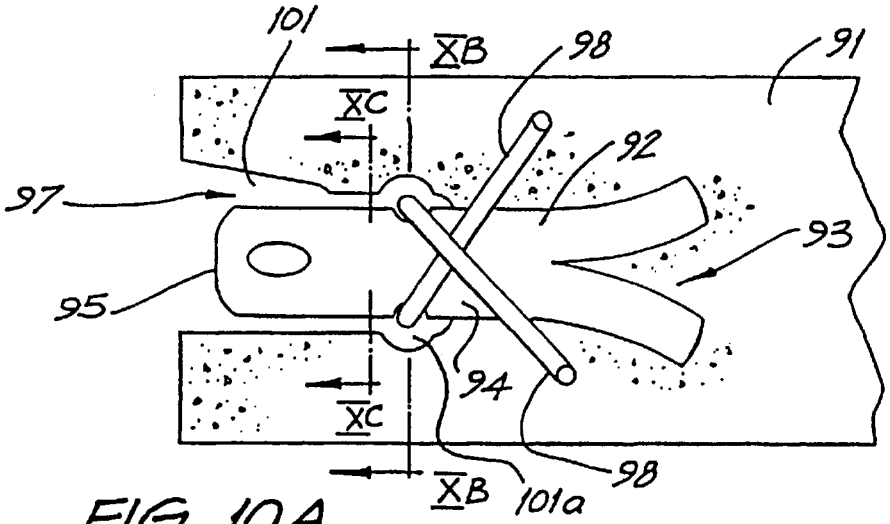
FIG. 10A is a transverse cross-sectional view in the direction of arrows XA—XA of FIG. 9A.
Figure 10C:
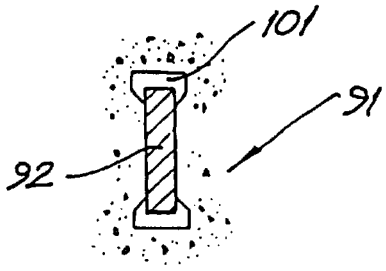
FIG. 10C is a transverse cross-sectional view along the lines XC—XC of FIG. 10A.
Figure 10B:
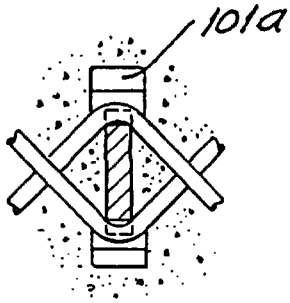
FIG. 10B is a transverse cross-sectional view along the lines XB—XB of FIG. 10A.

An anchor device 90 of a fifth embodiment is illustrated in FIGS. 9 and 10. The anchor device 90 embedded in a concrete slab 91, includes an anchor element 92 having a forked foot 93, a shank 94 and a head 95 having a hole passing through. The head 95 of the anchor element 92 is positioned within a recess 97 and is able to be attached to a lifting device (not illustrated). Shear reinforcement 98 is provided. The reinforcement includes two bars which each have a brace portion 99 and a pair of legs 100. The brace portion 99 ensures that there is an air gap 101 between the concrete of the recess 97 and the anchor element 92. The anchor device 90 acts in the same manner as previously described.

In a first modification to the anchor device 90, as illustrated in FIGS. 9A, 10A, 10B and 10C, an air gap 101*a* is cast into the concrete slab 91 when the recess 97 is formed. The reinforcement 98 and anchor element 92 are separated from the concrete in the region of expected deflection of the anchor element 92. In this modification the shear reinforcement 98 is embedded in the concrete slab both above and below the recess 97.

Figure 11:
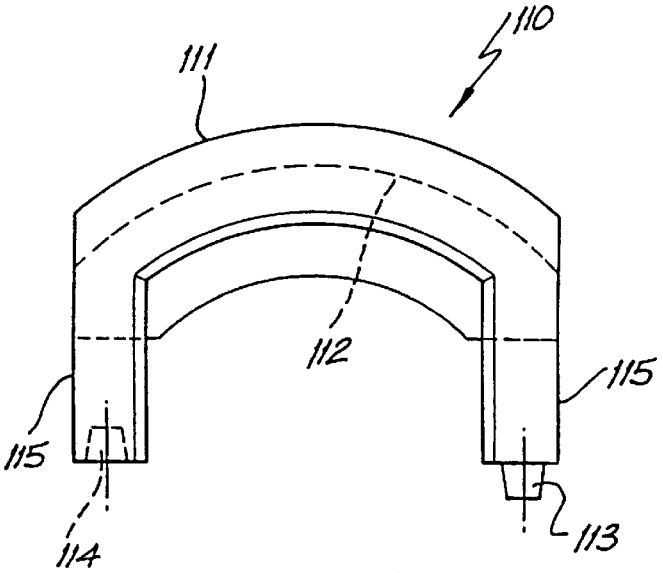
FIG. 11 is a front view of one half of a snap-on recess adaptor to be used with a recess former to hold the shear reinforcement for the anchor device of FIGS. 3 or 5.
Figure 12:
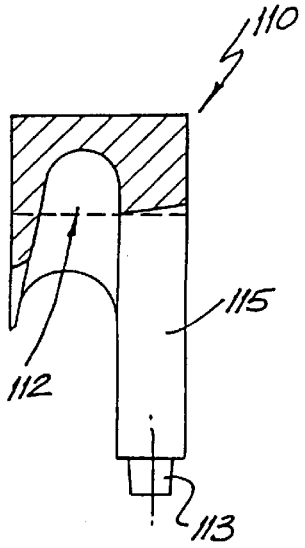
FIG. 12 is a side elevational view of the adaptor of FIG. 11.
Figure 13:
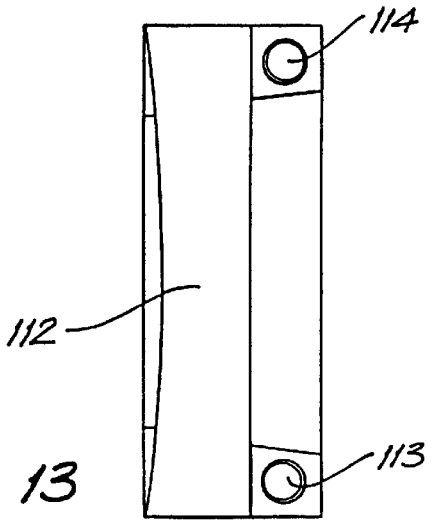
FIG. 13 is a bottom view of the adaptor of FIG. 11.

One half of a snap on recess adaptor 110 is illustrated in FIGS. 11–13. The adaptor 110 is able to be clipped onto an existing recess former (not illustrated) to support the shear reinforcement (not illustrated) to make the air gap between the shear reinforcement and the concrete within a concrete slab. The adaptor 110 includes a curved portion 111 having a channel 112 into which the shear reinforcement is able to be placed. The two halves of the adaptor 110 are snapped together via a male prong 113 which snaps into a female socket 114. The prong 113 and socket 114 are both located on different ones of connecting portions 115 of the adaptor 110. The shape of the adaptor 110 is used on a recess former which is used to make a truncated hemispherical recess as illustrated in FIGS. 3 and 5.

Figure 14:
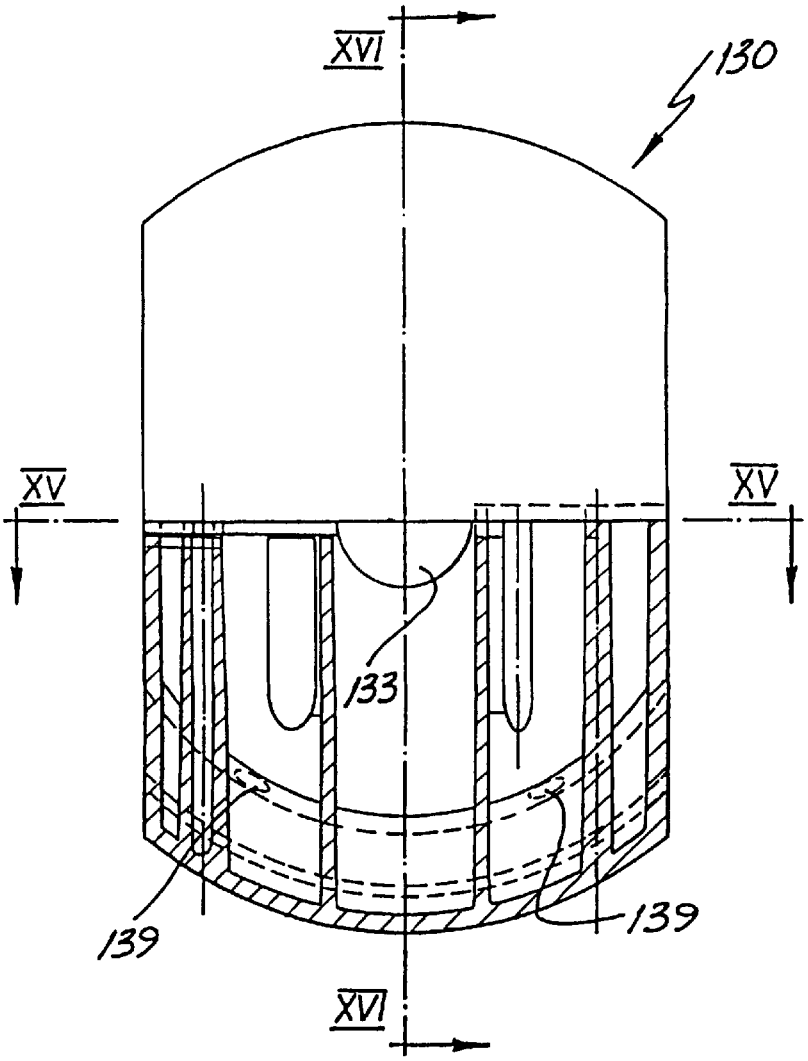
FIG. 14 is a partial cutaway view of a recess former of a preferred embodiment.
Figure 15:
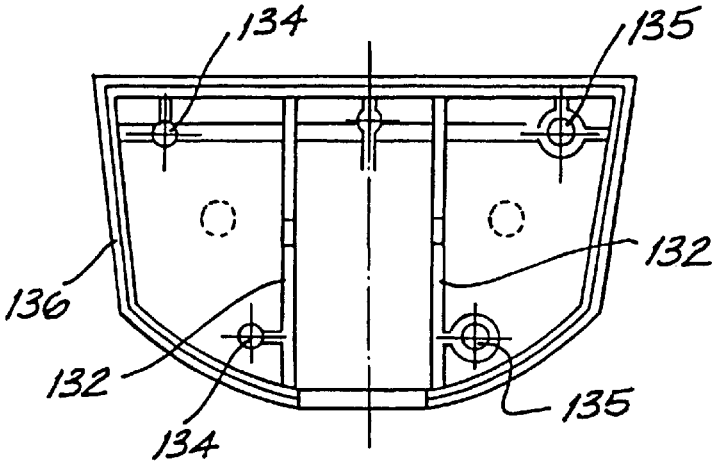
FIG. 15 is a transverse cross-section view along the lines XV—XV of FIG. 14.
Figure 16:
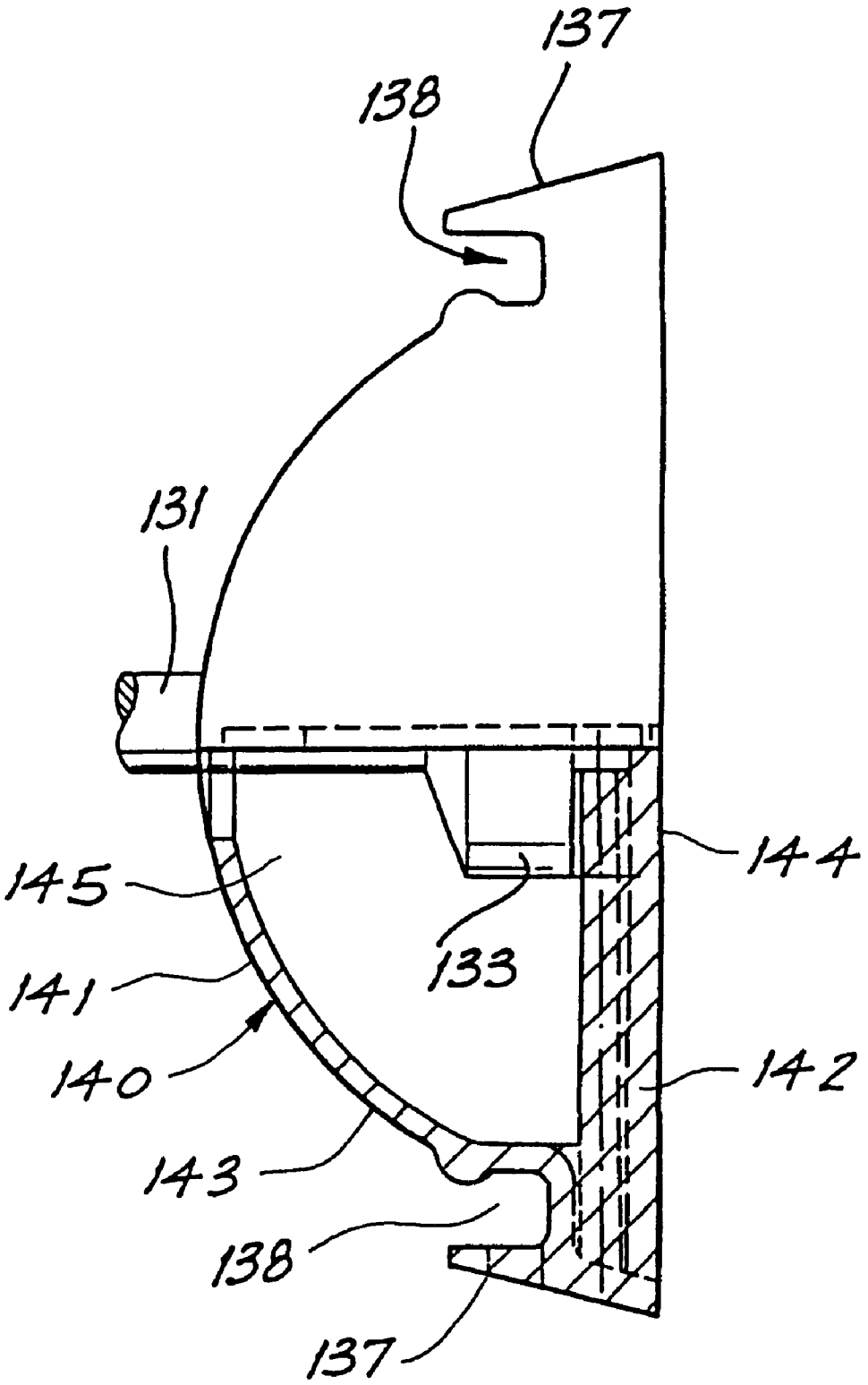
FIG. 16 is a longitudinal cross-sectional view along the lines XVI—XVI of FIG. 14.

In FIGS. 14–16, a recess former 130 is illustrated. The recess former 130 is a two-part moulded plastics former which is able to be snapped together to form a truncated hemispherical body. The recess former 130 includes a hole at the rear to allow an anchor 131 to extend out of the recess former 130. A pair of anchor head supports 132 are used to support the head 133 of the anchor 131. The recess former 130 includes pegs 134 and holes 135 which mate to keep the two-parts snapped together. A sealing lip 136 surround the recess former 130 and seals the two-parts when they are snapped together.

The truncated hemispherical recess former 130 includes a web 137 located at its outer curved surfaces. The web 137 includes a channel 138 in which a curved portion of shear reinforcement bars (not illustrated) are locatable. The web 137 is used to form a void or air gap between the shear reinforcement and the concrete once the recess former has been used in the casting of the concrete.

The channel 138 includes a plurality of retaining clips 139 which are used to ensure that the shear reinforcement remains in position in the channel 138.

The former 130 has a hollow body 140. The body 140 has a curved portion 141 which co-operates with a generally planar closure portion 142. The curved portion 141 has a convex curved surface 143 which abuts the concrete. The portion 142 has a surface 144 which is to be generally coplanar with the edge face of the concrete slab within which the former 130 is embedded. The curved portion 141 and closure portion 142 co-operate to generally enclose a space 145 within which the head 133 is located. As mentioned previously, the former 130 is formed of two parts which are secured together. Each part is provided with a portion of the head 133 as well as a respective web 137 and support 132. Each of the webs 137 projects from the closure portion 142 and is spaced from the surface 143 so as to provide the channels 138.

The foregoing describes only some embodiments of the present invention and modifications, obvious to those skilled in the art, can be made thereto without departing from the scope of the present invention.

For example, the air gap which is provided between the reinforcement and the concrete in the recess can have a soft compressible material (such as a sponge material 177 in FIG. 8) located therein. The soft compressible material (or air gap) is used to isolate the shear reinforcement from the concrete so that the reinforcement will not bear against the concrete in the direction of lift before the load is transferred and shed to the required area.

For example a device can be simply placed over the shear reinforcement to prevent it contacting the concrete. One such device can be a piece of material which is removable or easily compressible and attached to the reinforcement. Such a device can be incorporated into a recess former for the anchor device. Such a recess former would normally be designed to support the shear reinforcement to maintain it in the optimum position.

What is claimed is:

1. A recess former for forming a recess around a head of an anchor element embedded in an edge of a concrete slab during casting of the slab, the recess extending into the slab from an edge face of the edge of the slab, the former having:

a hollow body including a curved portion extending from a closure portion, the curved portion having a curved convex surface to abut the concrete, and the closure portion having a surface to be generally coplanar with the edge face;

a generally central hole in said curved portion through which the element would project to locate said head in a space generally enclosed by said curved portion and said closure portion; and a web projecting from said closure portion adjacent said cured portion but spaced therefrom to provide a channel between said web and said curved portion within which a sheer reinforcement may be located.

2. The recess former of claim 1 wherein said web is a first web, which first web is located on one side of said curved surface, with said former further including a second web projecting from said closure portion, the second web being located adjacent said curved portion but spaced therefrom to provide a channel between said web and curved portion within which a sheet reinforcement may be located, with said second web being located on the opposite side of said curved portion relative to said first web.

3. The recess former of claim 2 wherein said former is formed of two parts which are secured together, each part having a portion of said hole and a respective one of the webs.

* * * * *